US007819349B2

(12) United States Patent
Johnson et al.

(10) Patent No.: US 7,819,349 B2
(45) Date of Patent: Oct. 26, 2010

(54) ENTRANCE CHUTE FOR BLOWING INSULATION MACHINE

(75) Inventors: Michael W. Johnson, Lithopolis, OH (US); Michael E. Evans, Granville, OH (US); Agustin Hernandez, Blacklick, OH (US); Robert J. O'Leary, Newark, OH (US); Christopher M Relyea, Columbus, OH (US); Brian K Linstedt, Ostrander, OH (US); Hugo E Eccles, New York City, NY (US); Jeffrey W Servaites, Centerville, OH (US); John B Youger, Columbus, OH (US); Gregory J Merz, Gahanna, OH (US); Joseph M Sexton, Dublin, OH (US); Jeffrey D. Accursi, Columbus, OH (US); Christopher H. Kujawski, Columbus, OH (US); Robert O'Grady, Columbus, OH (US); Keith A Grider, Chicago, IL (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 5 days.

(21) Appl. No.: 11/581,661

(22) Filed: Oct. 16, 2006

(65) Prior Publication Data

US 2008/0089748 A1 Apr. 17, 2008

(51) Int. Cl.
*B02C 19/00* (2006.01)

(52) U.S. Cl. ..... 241/60; 241/101.4; 241/605

(58) Field of Classification Search ..... 241/60, 241/101.78, 277, 605, 18, 224, 225, 101.4; 239/379, 345; 83/946, 856
See application file for complete search history.

(56) References Cited

U.S. PATENT DOCUMENTS

| | | | |
|---|---|---|---|
| 313,251 | A | 3/1885 | Taylor |
| 1,630,542 | A | 5/1927 | Schulz |
| 1,718,507 | A | 6/1929 | Wenzel et al. |
| 1,811,898 | A | 6/1931 | Schur et al. |
| 2,049,063 | A | 7/1936 | Hubbard |

(Continued)

FOREIGN PATENT DOCUMENTS

| | | |
|---|---|---|
| DE | 3238492 | 4/1984 |

(Continued)

OTHER PUBLICATIONS

Hearing Testimony, Case No. 09 CV 263 Division 2, Boulder County District Court, Colorado, Apr. 28, 2009, 11 pages.
Hearing Testimony, Case No. 09 CV 263 Division 2, Boulder County District Court, Colorado, Apr. 29, 2009, 14 pages.
Hearing Testimony, Case No. 09 CV 263 Division 2, Boulder County District Court, Colorado, Apr. 30, 2009, 35 pages.

(Continued)

*Primary Examiner*—Mark Rosenbaum
(74) *Attorney, Agent, or Firm*—MacMillan, Sobanski & Todd, LLC

(57) ABSTRACT

A machine for distributing blowing insulation from a bag of compressed blowing insulation. The machine includes a chute having an inlet end and an outlet end and is configured to receive the bag of compressed blowing insulation, a plurality of shredders mounted at the outlet end of the chute and configured to shred and pick apart the blowing insulation and a discharge mechanism for distributing the blowing insulation into an airstream. The chute has a cross-sectional shape that approximates the cross-sectional shape of the bag of compressed blowing.

2 Claims, 9 Drawing Sheets

U.S. PATENT DOCUMENTS 2,057,121 A 10/1936 Trevellyan
2,057,122 A 10/1936 Trevellyan
2,193,849 A 3/1940 Whitfield
2,200,713 A 5/1940 Ericson et al.
2,235,542 A 3/1941 Wenzel
2,262,094 A 11/1941 Burt
2,273,962 A 2/1942 Hubbard
2,291,871 A 8/1942 Bokum et al.
2,308,197 A 1/1943 Meyer
2,311,773 A 2/1943 Patterson
2,355,358 A 8/1944 Anderson
2,404,678 A 7/1946 Erb
2,437,831 A 3/1948 Moore
2,532,318 A 12/1950 Mackey et al.
2,532,351 A 12/1950 Wedebrock
2,550,354 A 4/1951 Jacobsen
2,618,817 A 11/1952 Slayter
2,721,767 A 10/1955 Kropp
2,754,995 A 7/1956 Switzer
2,794,454 A 6/1957 Moulthrop
2,869,793 A * 1/1959 Montgomery ..... 241/50
2,938,651 A 5/1960 Specht et al.
2,964,896 A 12/1960 Finocchiaro
2,984,872 A 5/1961 France
2,989,252 A 6/1961 Babb
3,051,398 A * 8/1962 Babb ..... 241/136
3,076,659 A 2/1963 Kremer
3,175,866 A 3/1965 Nichol
3,201,007 A 8/1965 Transeau
3,231,105 A 1/1966 Easley
3,278,013 A 10/1966 Banks
3,314,732 A 4/1967 Hagan
3,399,931 A 9/1968 Vogt
3,403,942 A 10/1968 Farnworth
3,485,345 A 12/1969 Deasy
3,512,345 A 5/1970 Smith
3,556,355 A 1/1971 Ruiz
3,591,444 A 7/1971 Hoppe et al.
3,703,970 A 11/1972 Benson
3,747,743 A 7/1973 Hoffman, Jr.
3,861,599 A 1/1975 Waggoner
3,869,337 A 3/1975 Hoppe et al.
3,895,745 A 7/1975 Hook
1,418,882 A 12/1975 Anderson et al.
3,952,757 A 4/1976 Huey
3,995,775 A 12/1976 Birkmeier et al.
4,059,205 A 11/1977 Heyl
4,129,338 A 12/1978 Mudgett
4,133,542 A 1/1979 Janian et al.
4,134,508 A * 1/1979 Burdett, Jr. ..... 414/810
4,155,486 A 5/1979 Brown
4,179,043 A 12/1979 Fischer
4,180,188 A 12/1979 Aonuma et al.
4,236,654 A * 12/1980 Mello ..... 222/238
4,268,205 A 5/1981 Vacca et al.
4,273,296 A 6/1981 Hoshall
4,337,902 A 7/1982 Markham
4,344,580 A * 8/1982 Hoshall et al. ..... 241/60
4,346,140 A 8/1982 Carlson et al.
4,365,762 A 12/1982 Hoshall
4,381,082 A 4/1983 Elliott et al.
4,411,390 A 10/1983 Woten
4,465,239 A 8/1984 Woten
4,536,121 A 8/1985 Stewart et al.
4,537,333 A 8/1985 Bjerregaard
4,560,307 A 12/1985 Deitesfeld
4,585,239 A 4/1986 Nicholson
4,640,082 A 2/1987 Gill
4,695,501 A 9/1987 Robinson
4,716,712 A 1/1988 Gill
4,784,298 A 11/1988 Heep et al.
4,880,150 A 11/1989 Navin et al.
4,915,265 A 4/1990 Heep et al.
4,919,403 A 4/1990 Bartholomew
4,978,252 A 12/1990 Sperber
5,014,885 A 5/1991 Heep et al.
5,037,014 A 8/1991 Bliss
5,052,288 A 10/1991 Marquez et al.
5,129,554 A 7/1992 Futamura
5,156,499 A 10/1992 Miklich
5,166,236 A 11/1992 Alexander et al.
5,289,982 A 3/1994 Andersen
5,303,672 A 4/1994 Morris
5,323,819 A 6/1994 Shade
5,368,311 A 11/1994 Heyl
5,380,094 A 1/1995 Schmidt et al.
5,392,964 A 2/1995 Stapp et al.
5,405,231 A 4/1995 Kronberg
5,462,238 A * 10/1995 Smith et al. ..... 241/243
5,472,305 A 12/1995 Ikeda et al.
5,511,730 A 4/1996 Miller et al.
5,601,239 A 2/1997 Smith et al.
5,620,116 A 4/1997 Kluger et al.
5,624,742 A 4/1997 Babbitt et al.
5,639,033 A 6/1997 Miller et al.
5,642,601 A 7/1997 Thompson, Jr. et al.
5,647,696 A 7/1997 Sperber
5,683,810 A 11/1997 Babbitt et al.
5,819,991 A 10/1998 Kohn et al.
5,829,649 A 11/1998 Horton
5,860,232 A 1/1999 Nathenson et al.
5,860,606 A * 1/1999 Tiedeman et al. ..... 241/55
5,927,558 A 7/1999 Bruce
5,934,809 A 8/1999 Marbler
5,987,833 A 11/1999 Heffelfinger et al.
5,997,220 A 12/1999 Wormser
6,004,023 A 12/1999 Koyanagi et al.
6,036,060 A 3/2000 Munsch et al.
6,070,814 A 6/2000 Deitesfeld
6,074,795 A 6/2000 Watanabe et al.
6,109,488 A * 8/2000 Horton ..... 222/636
6,161,784 A 12/2000 Horton
6,209,724 B1 4/2001 Miller
6,266,843 B1 7/2001 Doman et al.
6,296,424 B1 10/2001 Eckel et al.
6,312,207 B1 11/2001 Rautiainen
6,503,026 B1 1/2003 Mitchell
6,510,945 B1 1/2003 Allwein et al.
6,578,784 B1 * 6/2003 Lischynski et al. ..... 241/189.1
6,648,022 B2 11/2003 Pentz et al.
6,698,458 B1 3/2004 Sollars
6,779,691 B2 8/2004 Cheng
6,783,154 B2 8/2004 Persson et al.
6,796,748 B1 9/2004 Sperber
6,826,991 B1 12/2004 Rasmussen
7,284,715 B2 10/2007 Dziesinski et al.
7,354,466 B2 * 4/2008 Dunning et al. ..... 55/385.1
2001/0036411 A1 11/2001 Walker
2002/0074436 A1 * 6/2002 Hruska ..... 241/194
2003/0075629 A1 4/2003 Lucas
2003/0192589 A1 10/2003 Jennings
2003/0215165 A1 11/2003 Hogan et al.
2003/0234264 A1 12/2003 Landau
2004/0124262 A1 7/2004 Bowman et al.
2005/0006508 A1 1/2005 Roberts
2005/0242221 A1 11/2005 Rota
2006/0024456 A1 2/2006 O'Leary et al.
2006/0024457 A1 2/2006 O'Leary et al.
2006/0024458 A1 2/2006 O'Leary et al.
2006/0231651 A1 * 10/2006 Evans et al. ..... 241/60
2007/0138211 A1 6/2007 O'Leary et al.

2008/0087751 A1 4/2008 Johnson et al.

FOREIGN PATENT DOCUMENTS

| | | |
|---|---|---|
| DE | 3240126 | 5/1984 |
| EP | 0265751 | 4/1988 |
| FR | 2350450 | 3/1979 |
| GB | 1418882 | 12/1975 |
| GB | 1574027 | 9/1980 |
| GB | 2 099 776 | 12/1982 |
| GB | 2124194 | 2/1984 |
| GB | 2156303 | 10/1985 |
| GB | 2212471 | 7/1989 |
| GB | 2276147 | 9/1994 |
| JP | 407088985 | 4/1995 |
| NL | 8 204 888 | 7/1984 |

OTHER PUBLICATIONS

Hearing Testimony, Case No. 09 CV 263, Boulder County District Court, Colorado, May 1, 2009, 18 pages.
Hearing Testimony, Case No. 09 CV 263 Division 2, Boulder County District Court, Colorado, May 4, 2009, 27 pages.
Hearing Testimony, Case No. 09 CV 263 Division 2, Boulder County District Court, Colorado, May 5, 2009, 5 pages.
Hearing Testimony, Case No. 09 CV 263 Division 2, Boulder County District Court, Colorado, May 7, 2009, 8 pages.
Hearing Testimony, Case No. 09 CV 263 Division K, Boulder County District Court, Colorado, May 7, 2009, 8 pages.
Operator's Manual for Unisul's Mini-Matic Insulation Blowing Maching, Mfg. By UNISUL, Winter Haven, FL, Publication: RTL 100-08/03, CT0000310-CT0000322, 13 pages.
Attic Protector Blow-In Fiber Glass, Johns Manville International-Insulation Group RIG 1718, Denver, CO, www.jm.com, 08100-REV, CT0000122-CT0000124, 3 page.
Blow-Matic 8, Abiff Manufacturing Corp., Denver, CO, www.fiberiffic.com, Copyright 2002-2004 Ark-Seal, LLC, CT0000550-CT0000552, 3 pages.
The Force/3 Insulation Blower, Intec, Frederick, CO, http://www.inteccorp.com/Force3.htm-Apr. 14, 2009, OC002923-OC002925, 3 pages.
The Quantum Insulation Blower, Intec, Frederick, CO, http://www.inteccorp.com/Quantum.htm-Apr. 14, 2009, OC002930-OC002931, 2 pages.
The Wasp Insulation Blower, Intec, Frederick, CO, http://www.intec-corp.com/Wasp.com-May 18, 2005, CT0000352-CT0000354, 3 pages.
Krendl #425, Krendl Machining Company, Delphos, OH, www.krendlmachine.com, Copyright Jan. 2009, CT000357-CT000358, 2 pages.
Krendl #250A, Krendl Machining Company, Delphos, OH, www.krendlmachine.com, Copyright Apr. 2008, CT000359-CT000360, 2 pages.
The Force/1, Intec, Frederick, CO, www.inteccorp.com, D200-0200-00, KL REV Mar. 2004, CT0000008-CT0000055, 50 pages.
Insulation Blowers—Accul 9118, Insulation Machine Corp., Springfield, MA, Copyright 2006, http://accuone.com/accul_9118.htm-Apr. 4, 2009, CT0000056-CT0000057, 2 pages.
AccuOne 9400, AccuOne Industries, Inc., Copyright 1998, http://www.accu1.com/A9400.htm1-Jul. 13, 2004, CT0000059, 1 page.
Krendl #450A, Krendl Machining Company, Delphos, OH, http://www.krendlmachine.com/products/450a.asp?PartNo=450A-Jul. 13, 2004, CT0000067-CT0000068, 2 pages.
Cocoon Insulation, Cocoon, Charlotte, NC, Copyright 2003 U.S. Green Fiber, LLC and Copright 2003 by Lowe's, CT0000071-CT0000076, 6 pages.
X-Floc Minifant M99, X-Floc GmbH, Renningen, Germany, Mar. 18, 2009, http://www.x-floc.com/en/machines/minifant-m99.html-Apr. 6, 2009 CT0000449-CT0000451, 3 pages.
X-Floc Zellofant M95, X-Floc GmbH, Renningen, Germany, Feb. 8, 2009, http://www.x-floc.com/en/machines/zellofant-m95.html-Apr. 13, 2009, CT0000107-CT0000112, 6 pages.
Isoblow Mini, Isocell Vertriebs G.M.B.H., Neumarkt Am Wallersee, Austria, www.isocell.at/home-page/blowing-technology/isoblow-mini.html-Apr. 4, 2009, CT0000436-CT0000438, 3 pages.
Meyer Series 700, "Reliable Hydraulic Power on the Industry's Mot Versatile Platform", Copyright 2007 Wm. W. Meyer & Sons, Inc., Libertyville, IL, www.meyerinsulation.com, CT0000602-CT0000603, 2 pages.
InsulMaxx 1000, Spray Insulation Components, Oklahoma City, OK, http://www.sprayinsulation.com/catalog.asp-Jan. 4, 2008, CT0000606-CT0000608, 3 pages.
U.S. Appl. No. 10/899,909—Advisory Action, May 26, 2009.
U.S. Appl. No. 10/899,909—Response to Final, May 12, 2009.
U.S. Appl. No. 10/899,909—Final Rejection, Mar. 20, 2009.
U.S. Appl. No. 10/899,909—Rejection, Sep. 20, 2007.
U.S. Appl. No. 10/899,909—Rejection, Apr. 4, 2008.
U.S. Appl. No. 10/899,909—Rejection, Sep. 9, 2008.
U.S. Appl. No. 10/899,909—Response, Aug. 27, 2007.
U.S. Appl. No. 10/899,909—Response, Dec. 20, 2007.
U.S. Appl. No. 10/899,909—Response, May 16, 2008.
U.S. Appl. No. 10/899,909—Response, Jan. 7, 2009.
U.S. Appl. No. 10/899,909—Restriction, Jul. 31, 2007.
U.S. Appl. No. 11/024,093—3 month office action, Mar. 2, 2007.
U.S. Appl. No. 11/024,093—3 month office action, Jul. 12, 2007.
U.S. Appl. No. 11/024,093—3 month office action, Mar. 5, 2009.
U.S. Appl. No. 11/024,093—Advisory Action, Jan. 11, 2008.
U.S. Appl. No. 11/024,093—Final 3 month, Oct. 24, 2007.
U.S. Appl. No. 11/024,093—RCE, Jan. 22, 2008.
U.S. Appl. No. 11/024,093—Response, Jan. 24, 2007.
U.S. Appl. No. 11/024,093—Response, Jun. 4, 2007.
U.S. Appl. No. 11/024,093—Response, Oct. 12, 2007.
U.S. Appl. No. 11/024,093—Response, Dec. 20, 2007.
U.S. Appl. No. 11/024,093—Response, May 28, 2009.
U.S. Appl. No. 11/024,093—Restriction, Nov. 24, 2006.
U.S. Appl. No. 11/303,612—3 Month, Oct. 15, 2009.
U.S. Appl. No. 11/303,612—Final 3 Month, Apr. 30, 2009.
U.S. Appl. No. 11/452,554—3 Month Office Action, Apr. 8, 2008.
U.S. Appl. No. 11/452,554—Advisory Action, Feb. 6, 2009.
U.S. Appl. No. 11/452,554—Final 3 Month, Oct. 15, 2008.
U.S. Appl. No. 11/452,554—Final 3 Month, May 5, 2009.
U.S. Appl. No. 11/452,554—RCE, Mar. 11, 2009.
U.S. Appl. No. 11/452,554—Response After Final, Jan. 14, 2009.
U.S. Appl. No. 11/581,660—3 month office, May 28, 2009.
U.S. Appl. No. 11/303,61—2 Response, Jan. 14, 2009.
U.S. Appl. No. 11/581,661—Response, Jul. 17, 2008.
U.S. Appl. No. 11/303,612—Response AF, Jun. 29, 2009.
U.S. Appl. No. 11/581,661—Response AF, Jan. 9, 2009.
U.S. Appl. No. 11/581,661—Response; RCE, Feb. 25, 2009.
Operator's Manual for Unisul's Mini-Matio Insulation Blowing Machine, Mfg. by UNISUL, Winter Haven, Fl, Publication: RTL 100, Aug. 2003, CT0000310-CT0000322, 13 pages.
The Force/3 Insulation Blower, Intec; Frederick, CO, www.intec-corp.com/Force3.htm, Apr. 14, 2009, OC002939-OX002926, 3 pages.
The Quantum Insulation Blower, Intec, Frederick, CO,www.intec-corp.com/Force3.htm, Apr. 14, 2009, OC002923-OC002931, 2 pages.
The Wasp Insulation Blower, Intec, Frederick, CO, www.inteccorp.com/Wasp.com, May 18, 2006, CT0000352-CT0000354, 3 pages.
The Force/1, Intec, Frederick, CO, , D200-0200-00, KL REV, Mar. 2004, CT000008-CT0000055, 50 pages.
Krendl #450A, Krendl Machining Company, Delphos, OH, http://?PartNo=450A, Jul. 13, 2004, CT0000067-CT0000068, 2 pages.
Insul/Maxx 1000, Spray Insulation Components, Oklahoma City, OK, www.sprayinsulation.com/catalog.asp, Jan. 4, 2008, CT0000606-CT0000608, 3 pages.
APSCO-Pneumatic Conveying: Dilute Phase Systems, Dense Phase Systems . . . Nov. 1, 2005.
Choose a pneumatic conveying system . . . ; Powder Bulk Engineering; Steve Grant, CSC Publishing, Dec. 2004.

* cited by examiner

ENTRANCE CHUTE FOR BLOWING INSULATION MACHINE

TECHNICAL FIELD

This invention relates to loose fill insulation for insulating buildings. More particularly this invention relates to machines for distributing loose fill insulation packaged in a bag.

BACKGROUND OF THE INVENTION

In the insulation of buildings, a frequently used insulation product is loose fill insulation. In contrast to the unitary or monolithic structure of insulation batts or blankets, loose fill insulation is a multiplicity of discrete, individual tufts, cubes, flakes or nodules. Loose fill insulation is usually applied to buildings by blowing the insulation into an insulation cavity, such as a wall cavity or an attic of a building. Typically, loose fill insulation is made of glass fibers although other insulation materials such as rock wool, other mineral fibers, organic fibers, polymer fibers, inorganic material, cellulose fibers and a mixture of the aforementioned materials can be used.

Fiberglass loose fill insulation, commonly referred to as blowing wool, is typically compressed and packaged in bags for transport from an insulation manufacturing site to a building that is to be insulated. Typically the bags are made of polypropylene or other suitable material. During the packaging of the blowing wool, it is placed under compression for storage and transportation efficiencies. Typically, the blowing wool is packaged with a compression ratio of at least about 10:1. The distribution of blowing wool into an insulation cavity typically uses a blowing wool distribution machine that feeds the blowing wool pneumatically through a distribution hose. Blowing insulation distribution machines typically have a large chute or hopper for containing and feeding the blowing insulation after the bag is opened and the blowing insulation is allowed to expand.

It would be advantageous if blowing insulation machines could be improved to make them safer and easier to use.

SUMMARY OF THE INVENTION

The above objects, as well as other objects not specifically enumerated, are achieved by a machine for distributing blowing insulation from a bag of compressed blowing insulation. The machine includes a chute having an inlet end and an outlet end and is configured to receive the bag of compressed blowing insulation, a plurality of shredders mounted at the outlet end of the chute and configured to shred and pick apart the blowing insulation and a discharge mechanism for distributing the blowing insulation into an airstream. The chute has a cross-sectional shape that approximates the cross-sectional shape of the bag of compressed blowing insulation.

According to this invention there is also provided a machine for distributing blowing insulation from a bag of compressed blowing insulation. The machine includes a chute having an inlet end and an outlet end. The chute is configured to receive the bag of compressed blowing insulation and includes a narrowed portion disposed between the inlet end and the outlet end. A cutting mechanism is connected to the chute and the cutting mechanism is configured to open the bag of blowing insulation. A shredder is mounted at the outlet end of the chute and is configured to shred and pick apart the blowing insulation. A discharge mechanism is provided for distributing the blowing insulation into an airstream. The narrowed portion of the chute urges the bag of compressed blowing insulation against the cutting mechanism to open the bag of blowing insulation.

According to this invention, there is also provided a machine for distributing blowing insulation from a bag of compressed blowing insulation. The machine includes a chute having an inlet end and an outlet end. The chute is configured to receive the bag of compressed blowing insulation. A cutting mechanism is connected to the chute and configured to open the bag of blowing insulation. The cutting mechanism includes a protective cover configured to substantially protect the machine operator from contact with the cutting mechanism. A plurality of shredders are mounted at the outlet end of the chute and are configured to shred and pick apart the blowing insulation. A discharge mechanism is provided for distributing the blowing insulation into an airstream.

According to this invention, there is also provided a machine for distributing blowing insulation from a bag of compressed blowing insulation. The machine includes a chute having an inlet end and an outlet end. The chute is configured to receive the bag of compressed blowing insulation and includes a guide assembly disposed between the inlet end and the outlet end. A cutting mechanism is connected to the guide assembly and is configured to open the bag of blowing insulation. A shredder is mounted to an outlet end of the chute and is configured to shred and pick apart the blowing insulation. A discharge mechanism is provided for distributing the blowing insulation into an airstream. The guide assembly urges the bag of compressed blowing insulation against the cutting mechanism to open the bag of blowing insulation.

Various objects and advantages of this invention will become apparent to those skilled in the art from the following detailed description of the preferred embodiment, when read in light of the accompanying drawings.

DETAILED DESCRIPTION OF THE INVENTION

The description and drawings disclose a blowing insulation machine 10 for distributing blowing insulation from a bag of compressed blowing insulation. As shown in FIGS.

Figure 3:
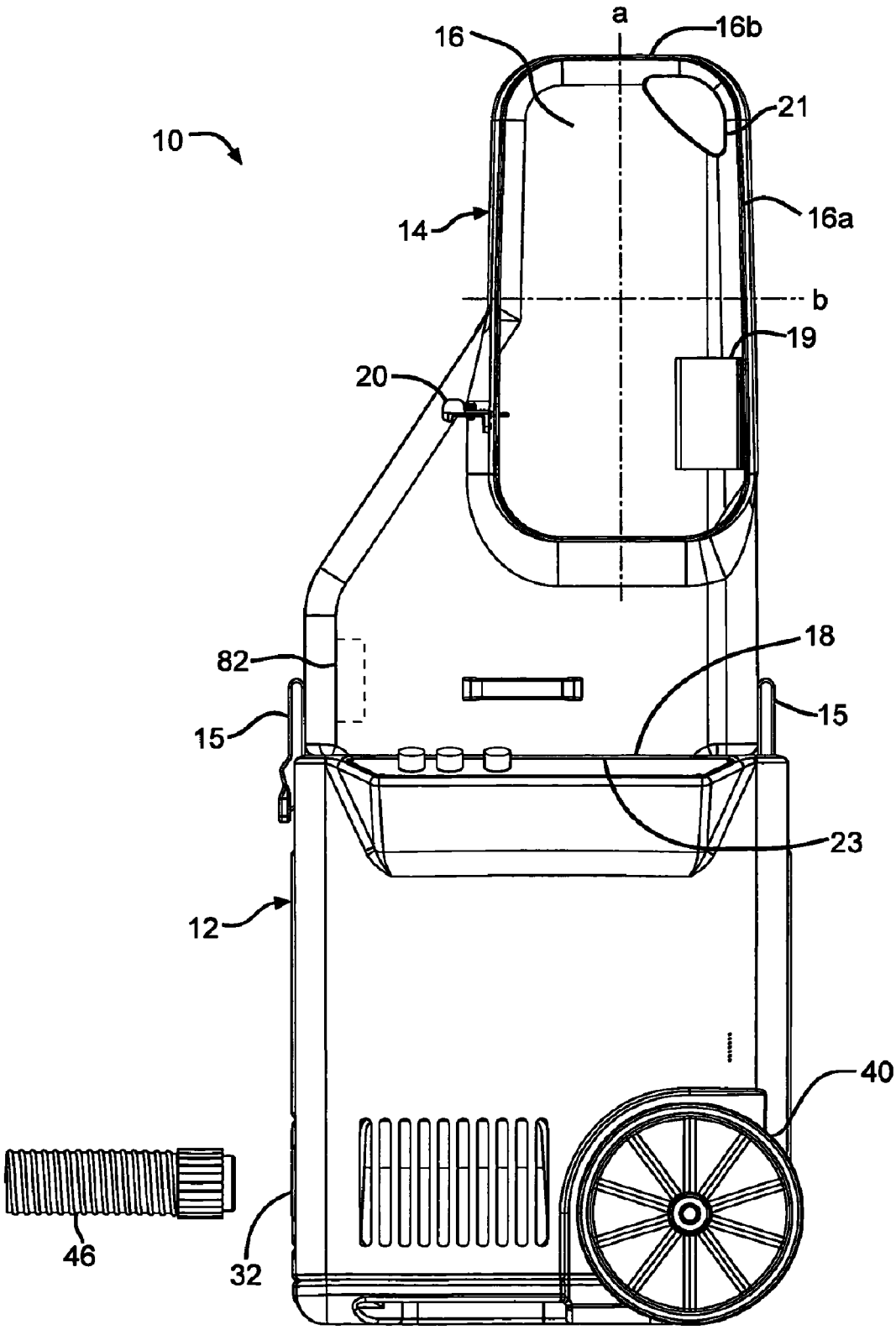
FIG. 3 is a side view in elevation of the insulation blowing insulation machine of FIG. 1.
Figure 4:
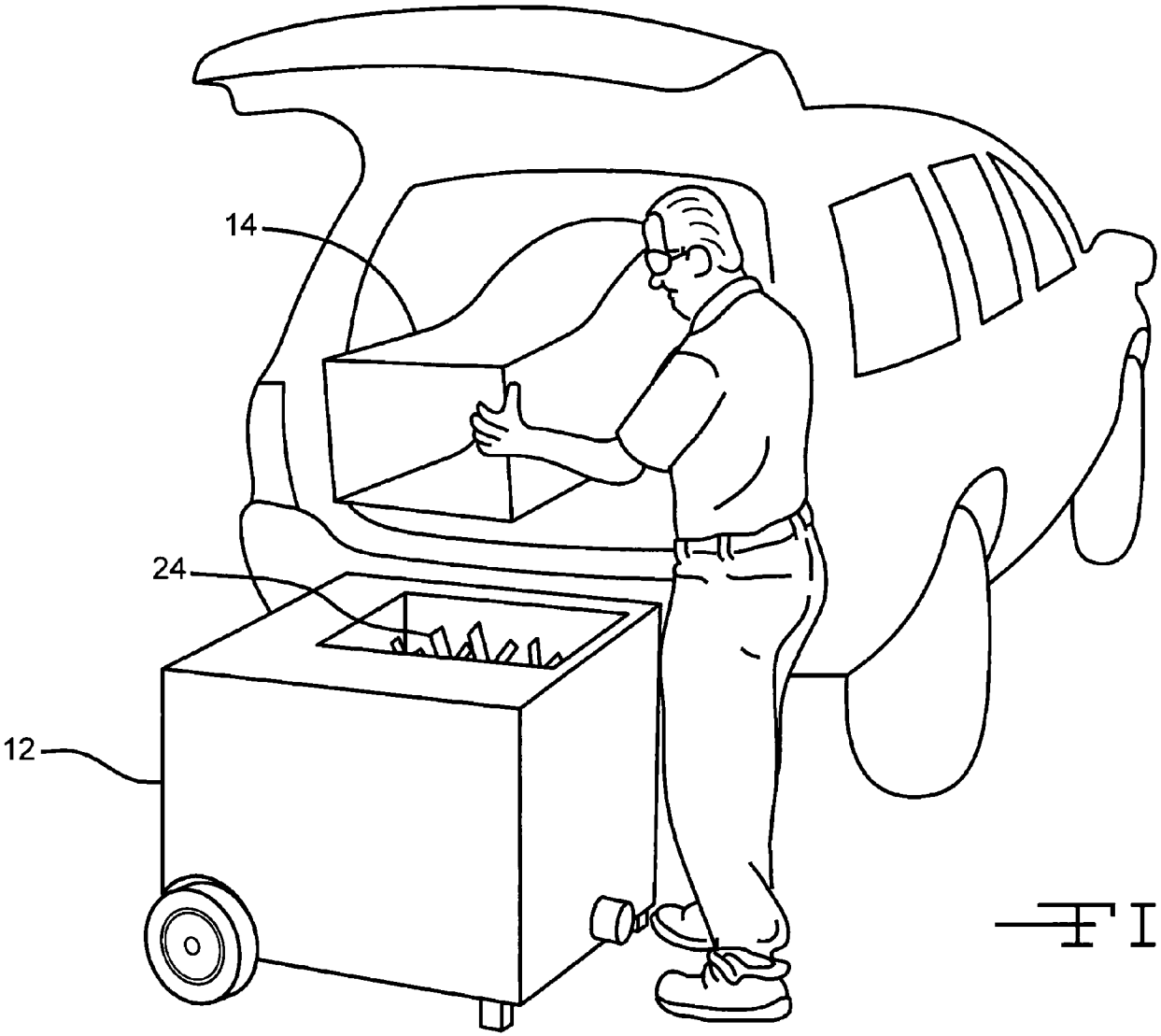
FIG. 4 illustrates the insulation blowing insulation machine, separated into the lower unit and chute, which can be readily loaded into a personal vehicle.

1-3, the blowing insulation machine 10 includes a lower unit 12 and a chute 14. The lower unit 12 is connected to the chute 14 by a plurality of fastening mechanisms 15. The fastening mechanisms 15 are configured to readily assemble and disassemble the chute 14 to the lower unit 12 for ease of transport in a personal vehicle as shown in FIG. 4. In this embodiment, the fastening mechanisms 15 are mechanical clips. Alternatively, assembly of the chute 14 to the lower unit 12 can be accomplished by the use of other fastening mechanisms, such as clamps, straps, bolts, magnets, or any other fastening mechanism suitable to allow ready disassembly and assembly. Additionally, the lower unit 12 and the chute 14 optionally can be configured for assembly and disassembly without the use of tools or by the use of simple hand tools such as a wrench, screwdriver or socket set. As further shown in FIGS. 1-3, the chute 14 has an inlet end 16 and an outlet end 18.

The chute 14 includes a narrowed portion 17 disposed between the inlet end 16 and the outlet end 18, as shown in FIGS. 1, 2, 8 and 9. The narrowed portion 17 has a smaller cross-sectional area than the remainder of the chute 14. In one embodiment, the smaller cross-sectional area of the narrowed portion 17 is formed by an optional guide assembly 19. In general, as the bag 22 of compressed blowing insulation enters the narrowed portion 17 of the chute 14 formed by the guide assembly 19, the narrowed portion 17 urges the bag 22 of compressed blowing insulation against a cutting mechanism 20 to open the bag 22.

Figure 2:
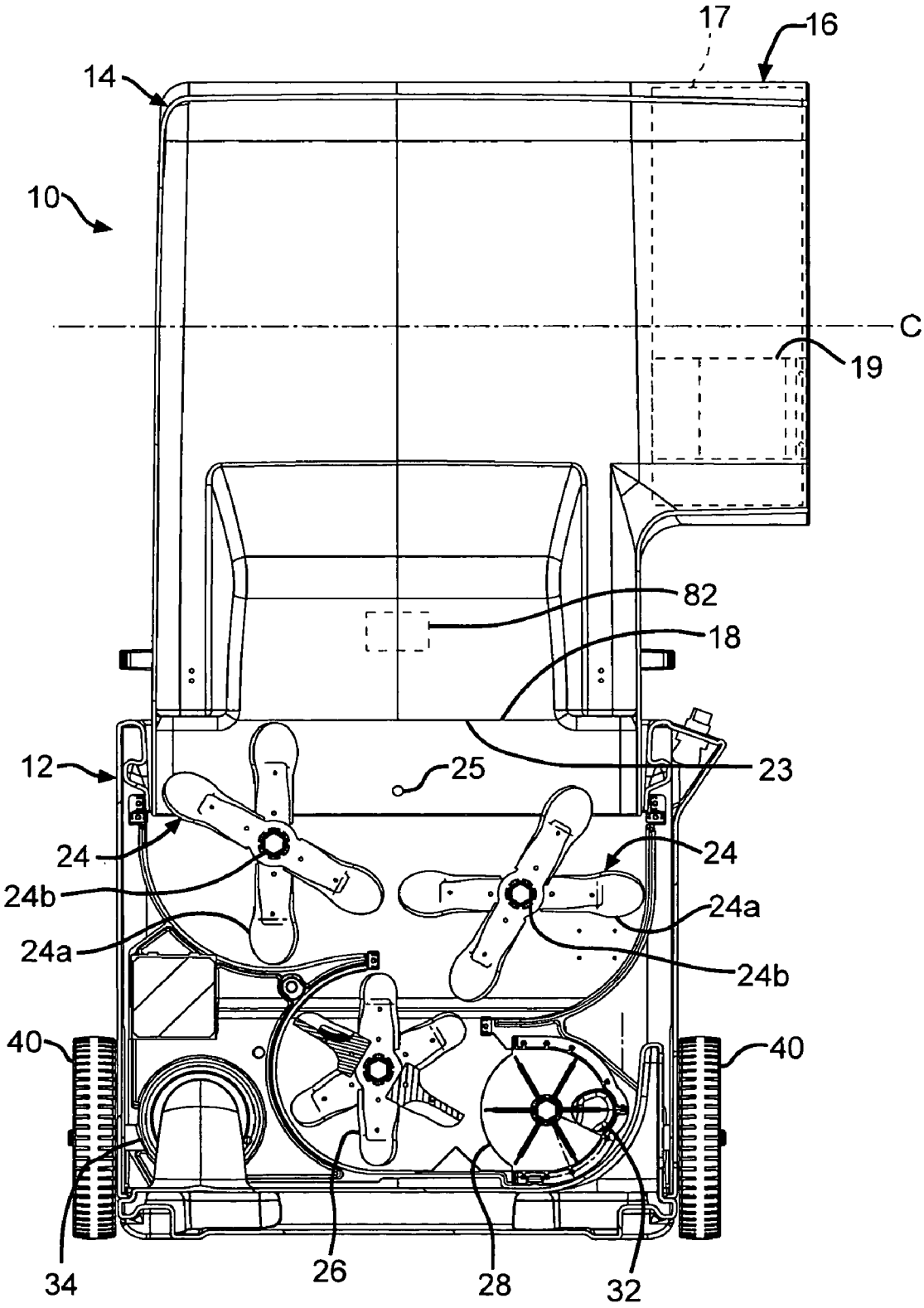
FIG. 2 is a front view in elevation, partially in cross-section, of the insulation blowing insulation machine of FIG. 1.

As shown in FIG. 2, a plurality of low speed shredders 24 are mounted in the lower unit 12 at the outlet end 18 of the chute 14 for shredding and picking apart the blowing insulation as the blowing insulation is discharged from the outlet end 18 of the chute 14 into the lower unit 12. In one embodiment, the plurality of low speed shredders 24 include at least two low speed shredders 24. Alternatively, any number of low speed shredders 24 could be used. In one embodiment, the low speed shredders 24 include a plurality of spaced apart paddles 24*a*, mounted for rotation on shredder shafts 24*b*. In this embodiment, the spaced apart paddles 24*a* are configured to shred and pick apart the blowing insulation. Alternatively, the shredder 24 can include spaced apart cutting blades configured to shred and pick apart the blowing insulation. Although the disclosed blowing insulation machine 10 is shown with a plurality of low speed shredders 24, any type of separator, such as a clump breaker, beater bar or any other mechanism that shreds and picks apart the blowing insulation can be used.

While the shredder 24 shown in FIG. 2 is configured to shred and pick apart the blowing insulation, it should be understood that the shredder 24 could also shred and pick apart the bag 22. However, shredding of the bag 22 by the shredders 24 is not necessary to the operation of the machine 10.

An agitator 26 is provided for final shredding of the blowing insulation and for preparing the blowing insulation for distribution into an airstream, as shown in FIG. 2. In one embodiment, the agitator 26 is a high speed shredder. In another embodiment, the blowing insulation machine could include a plurality of agitators 26 for shredding the blowing insulation and preparing the blowing insulation for distribution. Alternatively, the agitator 26 can be any means to further shred the blowing insulation in preparation for distribution into an airstream.

As shown in FIG. 2, a discharge mechanism 28 is positioned downstream from the agitator 26 to distribute the shredded blowing insulation into an airstream. Although the discharge mechanism 28 shown in FIG. 2 is a rotary valve, any type of discharge mechanism 28, including staging hoppers, metering devices, rotary feeders, or any other mechanism sufficient to distribute the shredded blowing insulation into an airstream can be used.

As best shown in FIG. 2, the shredded blowing insulation is driven through the discharge mechanism 28 and through the machine outlet 32 by an airstream provided by a blower (not shown) mounted in the lower unit 12.

The shredders 24, agitator 26 and the discharge mechanism 28 are mounted for rotation. They can be driven by any suitable means, such as by a motor 34, a gearbox (not shown) and belts (not shown) and pulleys (not shown). Alternatively, each of the shredders 24, agitator 26, and discharge mechanism 28 can be provided with its own motor.

Figure 1:
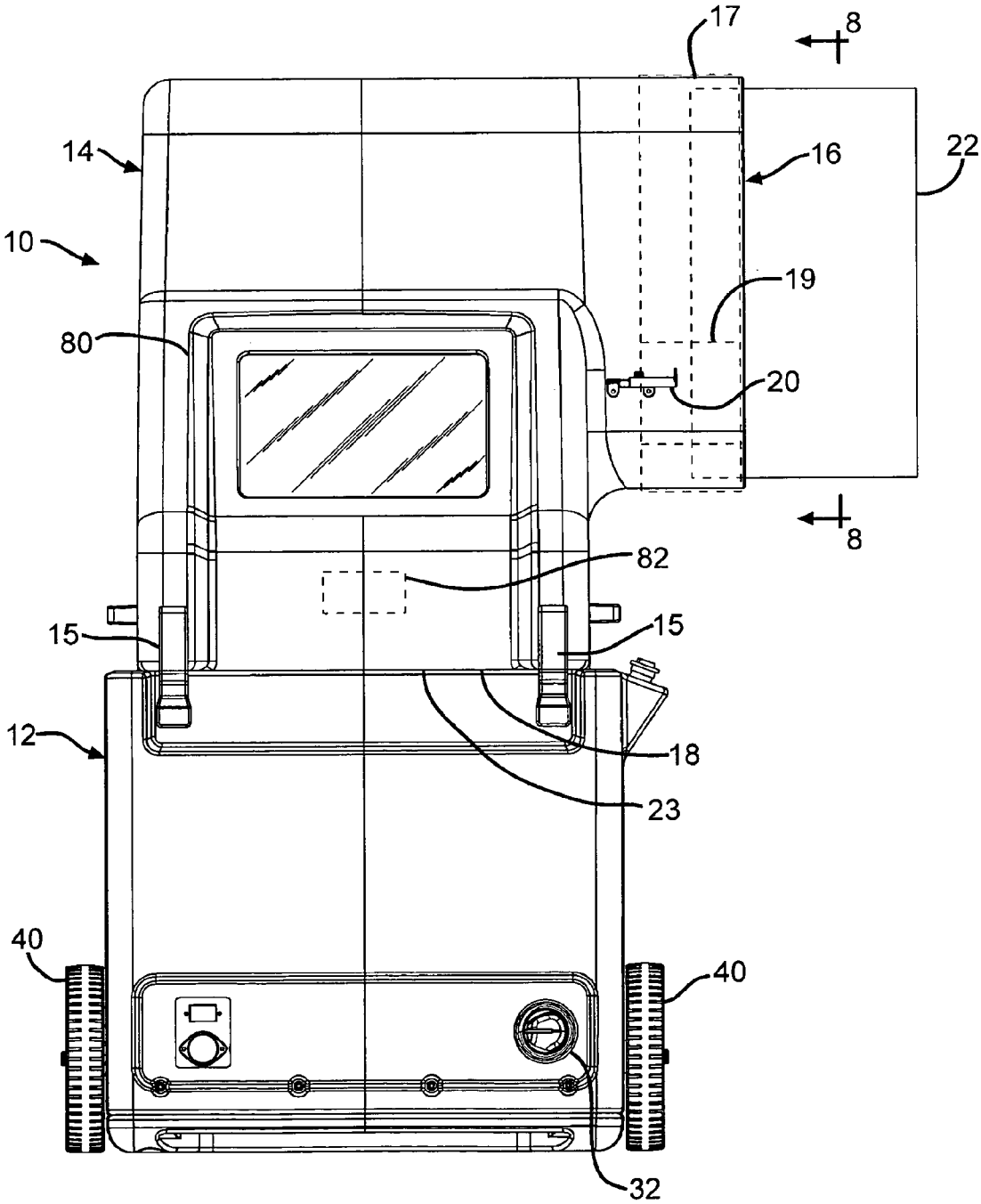
FIG. 1 is a side view in elevation of an insulation blowing insulation machine.

In general, the chute 14 guides the blowing insulation to the shredders 24 which shreds and pick apart the blowing insulation. The shredded blowing insulation drops from the shredders 24 into the agitator 26. The agitator 26 prepares the blowing insulation for distribution into an airstream by further shredding the blowing insulation. In this embodiment of the blowing insulation machine 10, the shredders 24 and the agitator 26 rotate at different speeds. The shredders 24 rotate at a generally lower speed and the agitator 26 rotates at a generally higher speed. Alternatively, the shredders 24 and the agitator 26 could rotate at substantially similar speeds or the shredders 24 could rotate at a higher speed than the agitator 26. The finely shredded blowing insulation drops from the agitator 26 into the discharge mechanism 28 for distribution into the airstream caused by the blower. The airstream, with the shredded blowing insulation, exits the machine 10 at the machine outlet 32 and flows through the distribution hose 46, as shown in FIG. 3, toward the insulation cavity, not shown As shown in FIGS. 1-3, the blowing insulation machine 10 is mounted on wheels 40, which allows the machine 10 to be moved from one location to another with relative ease. However, the wheels 40 are optional and are not necessary to the operation of the machine 10.

Figure 8:
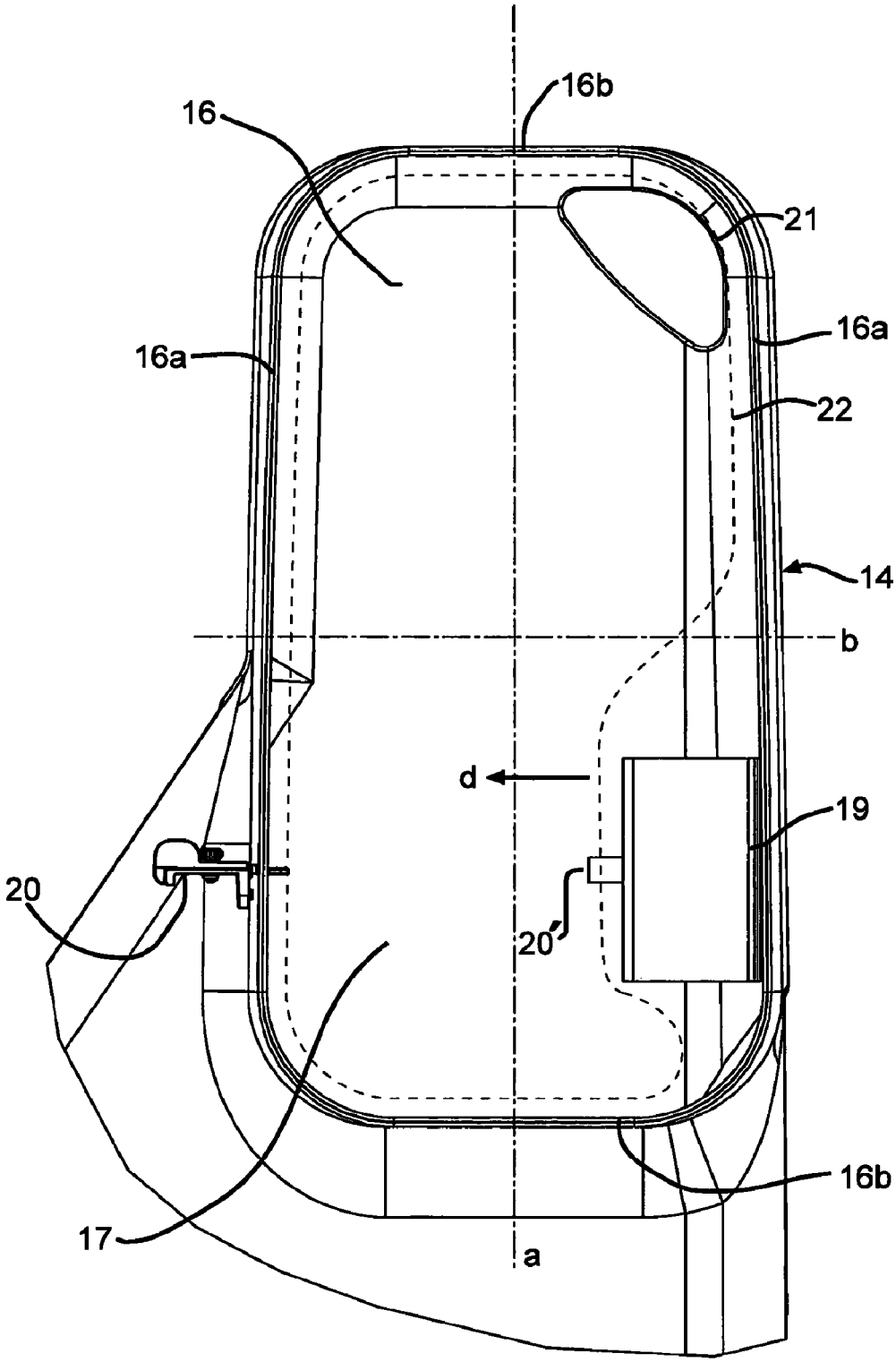
FIG. 8 is a side view of the chute of the insulation blowing insulation machine of FIG. 1.

As shown in FIGS. 1 and 2, the chute 14 comprises a one piece segment and can be made of any material, such as metal or reinforced plastic, suitable to receive the blowing insulation and introduce the blowing insulation to the shredders 24. Alternatively, the chute 14 can be constructed of various designs, such as discrete segments that fold upon themselves, telescoping segments that extend to open and locked positions or any other design suitable to receive the blowing insulation and introduce the blowing insulation to the shredders 24. Optionally, the chute 14 includes a handle segment 21, as shown in FIGS. 3 and 8, to facilitate ready movement of the blowing insulation machine 10 from one location to another. However, the handle segment 21 is not necessary to the operation of the machine 10.

In one embodiment, as shown in FIGS. 3 and 8, the chute 14 has a substantially rectangular cross-sectional shape that approximates the substantially rectangular cross-sectional shape of the bag 22 of compressed blowing insulation. Typical bags of compressed fiberglass, loose fill blowing insulation have rounded generally rectangular cross-sectional shapes. For example, the bag might have a height of about 8 inches, a width of about 19 inches and a length of about 38 inches. Such a bag might have a weight of about 35 pounds. For the bag specified above, the chute 12 might have a substantially rectangular cross-section shape of about 9 inches by 20 inches. The substantially rectangular cross-sectional shape of the chute allows the bag to be easily received and fed through the chute 14 and to be engaged by the shredders 24. By providing the chute 14 with a substantially rectangular cross-sectional shape that approximates the substantially rectangular cross-sectional shape of the bag 22, the bag 22 will be contained and prevented from expanding prior to the point at which the blowing insulation is engaged by the shredder 24.

Alternatively, the chute 14 may have a round cross-sectional shape that approximates the cross-sectional shape of a package of blowing insulation in roll form or any other cross-sectional shape that approximates the cross-sectional shape of the package of compressed blowing insulation.

The bag 22 of blowing insulation is typically under high compression. When the bag 22 is cut, the blowing insulation expands greatly. The blowing insulation must be contained in the chute 14 to avoid uncontrolled expansion. The outlet end 18 of the chute 14 allows the blowing insulation to expand as the bag 22 is pushed into the chute 14 and opened by the cutting mechanism 20. In essence, the chute 14 has a reverse funnel shape, going from the narrowed portion 17 to the wider outlet end 18 of the chute 14.

As previously discussed, typical bags of compressed blowing insulation have rounded generally rectangular cross-sectional shapes. For example, the bag might have a height of about 8 inches, a width of about 19 inches and a length of about 38 inches. Such a bag might have a weight of about 35 pounds. In one embodiment, to enable the machine user to readily and safely operate the machine 10, the bag 22 may be cut in half, resulting in two substantially equal size half bags filled with compressed blowing insulation. In operation, the machine user loads the opened end of one of the half bags into the chute 14 while gripping the unopened end of the half bag. The machine user continues gripping the unopened end of the half bag until all blowing insulation is removed from the half bag, at which time the half bag is removed from the chute 14 and discarded.

In one embodiment, as shown in FIGS. 3 and 8, the inlet end 16 of the chute 14 includes longitudinal sides 16*a* and lateral sides 16*b*. The longitudinal sides 16*a*, of the inlet end 16 of the chute 14, are configured to be substantially vertical and centered about major longitudinal axis a. The lateral sides 16*b* are configured to be substantially horizontal and centered about major lateral axis b. In this embodiment, the bag 22 of compressed blowing insulation is fed into the inlet end 16 of the chute 14 in a manner such that the bag 22 is substantially vertical. Alternatively, the chute 14 can be configured such that the bag 22 is substantially horizontal when fed into the inlet end of the chute 14.

When the chute 14 is removed from the lower unit 12, the operator of the machine has ready access to the shredders 24, to the outlet end 18 of the chute 14, and to the inlet end 23 of the lower unit 12 for inspection, cleaning, maintenance or any other service or safety requirement. In one embodiment as shown in FIG. 2, to ensure the safety of the operator, the chute 14 is provided with at least one electrical interlock 25 configured to disconnect power to the lower unit 12 such that the motor 34 cannot run while the chute 14 removed from the lower unit 12. Upon return of the chute 14 to its normal operating position, the electrical interlock 25 connects electrical power to the lower unit 12 and the motor 34 such that the motor 34 can operate. In this embodiment, the electrical interlock 25 is a magnetic switch. Alternatively, the electrical interlock can be any structure, switch or assembly that can interrupt power to the lower unit 12 when the chute 14 is removed from the lower unit 12 and connect power to the lower unit 12 when the chute 14 is reassembled to the lower unit 12.

In one embodiment of the blowing insulation machine 10, as shown in FIG. 1, the chute 14 includes at least one viewing port 80 configured to allow the user to view the blowing insulation in the machine 10. In this embodiment, the viewing port 80 comprises a clear plastic window, of generally rectangular shape, mounted to the chute 14 such that the operator can easily view the blowing insulation in the machine 10. Alternatively, the viewing port 80 could be a plurality of viewing ports or could be made of any material, shape or configuration that allows the operator to view the blowing insulation in the machine 10. Additionally, this embodiment of the blowing insulation machine 10 includes at least one chute light 82 mounted in the chute 14 at a convenient point in the chute 14 and configured to allow the machine user to view the blowing insulation in the machine 10. The chute light 82 comprises a low voltage illumination means configured to light the interior of the machine 10. In another embodiment, the blowing insulation machine 10 could include a plurality of chute lights 82 mounted at convenient points to illuminate various segments within the machine 10. Alternatively, the chute lights 82 could be mounted at the inlet end 16 of the chute 14 with the resulting illumination trained toward the outlet end 18 of the chute 14 or any other means of lighting the interior of the machine 10 sufficient to allow visual inspection through the viewing port 80.

Figure 5:
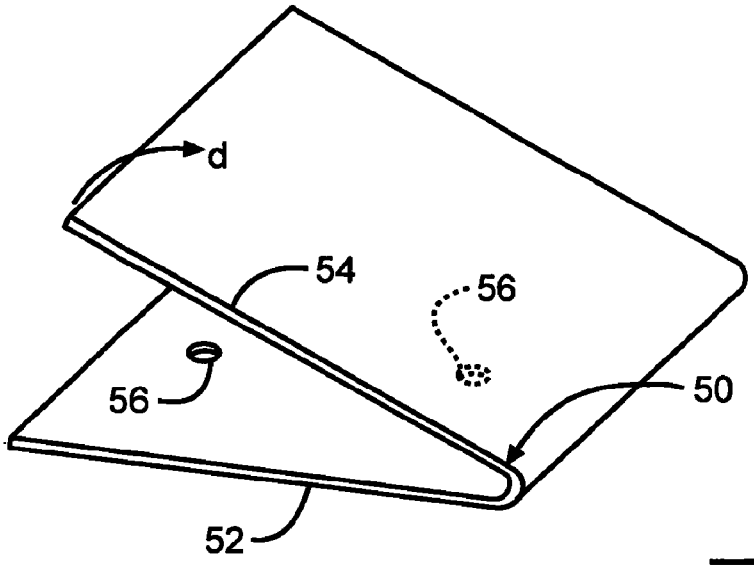
FIG. 5 is a side view in elevation of the V-shaped, spring guide assembly of the blowing insulation machine of FIG. 1.
Figure 9:
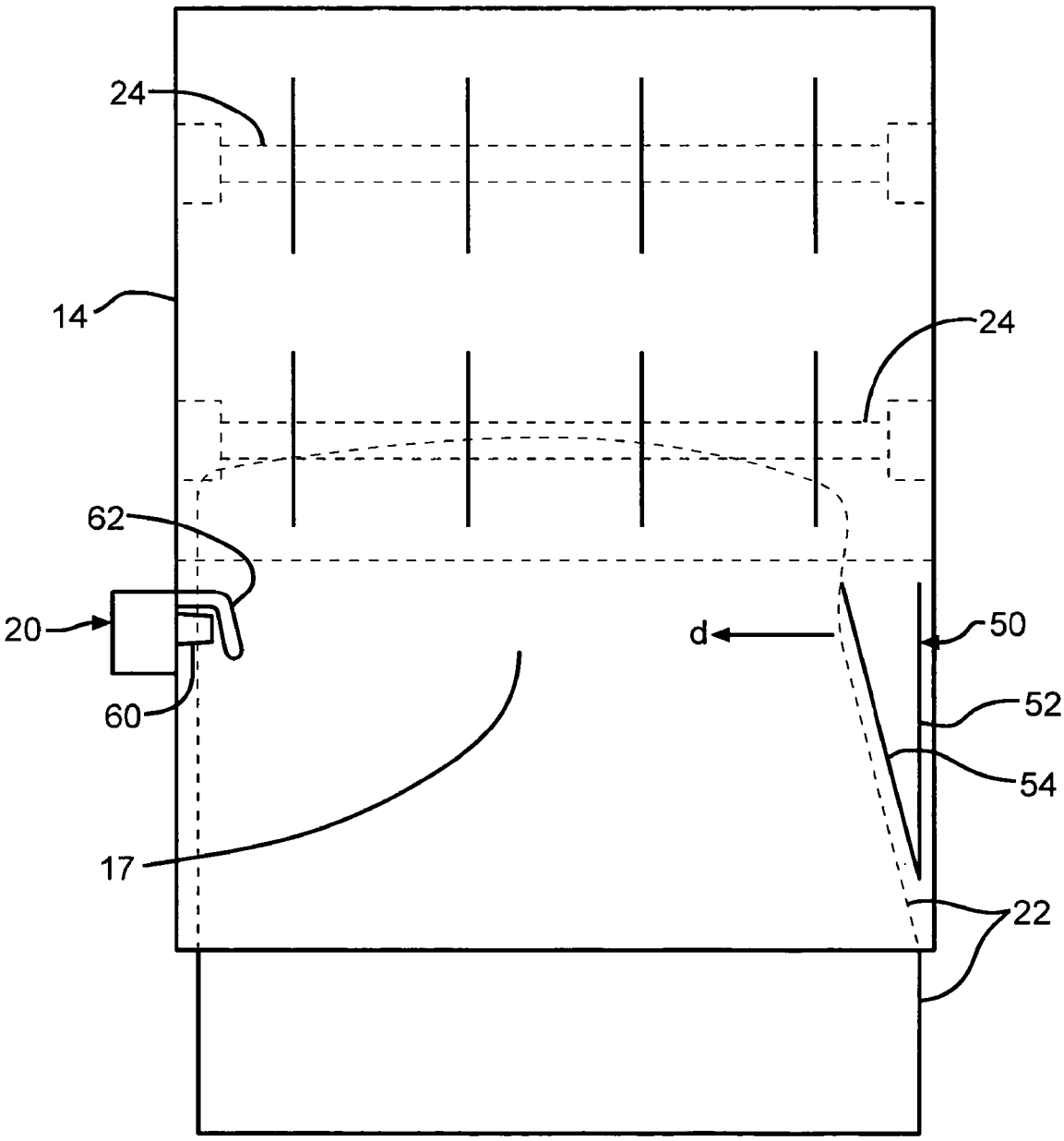
FIG. 9 is a plan view in elevation of the chute of the insulation blowing insulation machine of FIG. 1.

As previously discussed and as shown in FIGS. 1-3, the chute 14 optionally includes a guide assembly 19 mounted within the interior of the chute 14 and near the inlet end 16. The guide assembly 19 forms a narrowed portion 17 within the chute 14. As shown in FIG. 5, the guide assembly 19 can be a V-shaped spring 50 which includes a mounting leg 52 and a spring leg 54. In this embodiment, the V-shaped spring 50 is mounted to the interior of the chute 14 by attaching the mounting leg 52 using mounting bolts through the mounting holes 56 in the mounting leg 52. In another embodiment, the V-shaped spring 50 can be mounted to the interior of the chute 14 by any mechanical fastener or by an adhesive. Mounting of the guide assembly 19 to the interior of the chute 14 provides for a stationary guide assembly. The term "stationary", as used herein, is defined to mean the guide assembly 19 does not move in a direction toward the opposing longitudinal side 16*a*. In operation as shown in FIGS. 8 and 9, as the bag 22 enters the inlet end 16 of the chute 14, the bag 22 encounters the V-shaped spring 50. As the bag 22 further traverses the inlet end 16 of the chute 14, the bag 22 is urged by the spring leg 54 toward direction d. Urging of the bag 22 toward direction d forces the bag 22 against the cutting mechanism 20. The V-shaped spring 50 can be made of a rigid material, such as plastic, metal or any other material suitable to urge the bag 22 against the cutting mechanism 20 as the bag 22 traverses the inlet end 16 of the chute 14. In this embodiment, the spring leg 54 can be coated with a low coefficient of friction material configured to allow the bag to readily traverse the guide assembly 19.

Figure 6:
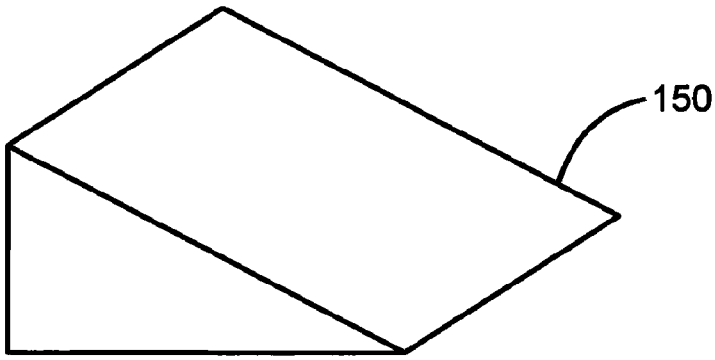
FIG. 6 is a perspective view of a wedge-shaped guide assembly.
Figure 7:
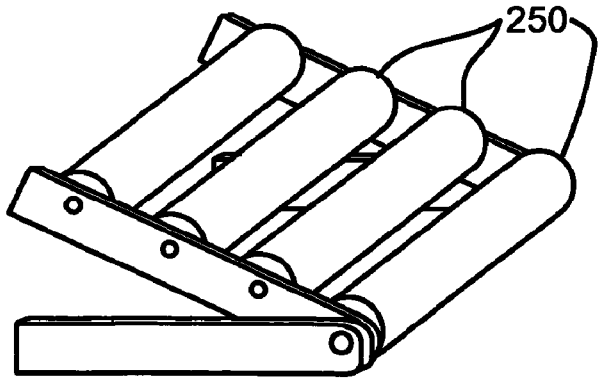
FIG. 7 is a perspective view of a roller guide assembly.

Alternatively, as shown in FIGS. 6 and 7, the guide assembly 19 can be any mechanism or structure, such as a wedge 150 or a series of rollers 250, or any other mechanism or structure configured to urge the bag 22 of compressed blowing insulation against the cutting mechanism 20.

As best shown in FIG. 8, the narrowed portion 17 formed by the guide assembly 19, extends vertically only a portion of the side 16*a* of the chute 14. In this embodiment as best shown in FIG. 2, the guide assembly 19 is configured to be below major axis c. In another embodiment, the guide assembly 19 forming the narrowed portion 17 is configured to be centered about major axis c or above major axis c. In another embodiment, the narrowed portion 17 extends vertically to the full height or width of the side 16*a* such that the narrowed portion 17 sufficiently urges the bag 22 of compressed blowing insulation to the opposite side of the chute 14. As shown in FIGS.

1 and 2, the narrowed portion 17 extends horizontally toward the outlet end 18 of the chute 14. In this embodiment, the narrowed portion 17 only extends horizontally to a portion of the overall length of the chute 14. The narrowed portion 17 need only extend horizontally toward the outlet end 18 of the chute 14 for a distance sufficient to urge the bag 22 of compressed blowing insulation against the cutting mechanism 20. The narrowed portion 17 can effectively urge the bag 22 to the opposite side of the chute 14 with an overall length of less than 40% of the length of the chute 14.

As shown in FIGS. 3, 8 and 9, the guide assembly 19 can be disposed on the interior side 16*a* of the chute 14. The guide assembly 19 can be located on the center of a side 16*a* within the interior of the chute 14 or any other position within the interior of the chute 14 sufficient to urge the bag 22 of blowing insulation against the cutting mechanism 20. Alternatively, the guide assembly 19 can be located on interior side 16*b* of the chute 14. In this embodiment, the guide assembly 19 can be located on the center of side 16*b* within the interior of the chute 14 or any other position within the interior of the chute 14 sufficient to urge the bag 22 of blowing insulation against the cutting mechanism 20.

In one embodiment, as shown in FIGS. 3 and 9, the cutting mechanism 20 is disposed within the narrow portion 17 of the chute 14 and opposite the guide assembly 19. The cutting mechanism 20 cuts the bag 22 and thereby opens the bag 22. In one embodiment as shown in FIG. 9, the cutting mechanism 20 can be mounted to the outside of the chute 14 by fasteners (not shown) such that a knife edge 60 and a protective cover 62 protrude within the interior of the chute 14. Alternatively, the cutting mechanism 20 could be mounted to the inside of the chute 14 or any other position sufficient to allow the cutting mechanism to open the bag 22 of blowing insulation. In another embodiment as shown in FIG. 8, the cutting mechanism 20' could be located on the guide assembly 19.

Figure 10:
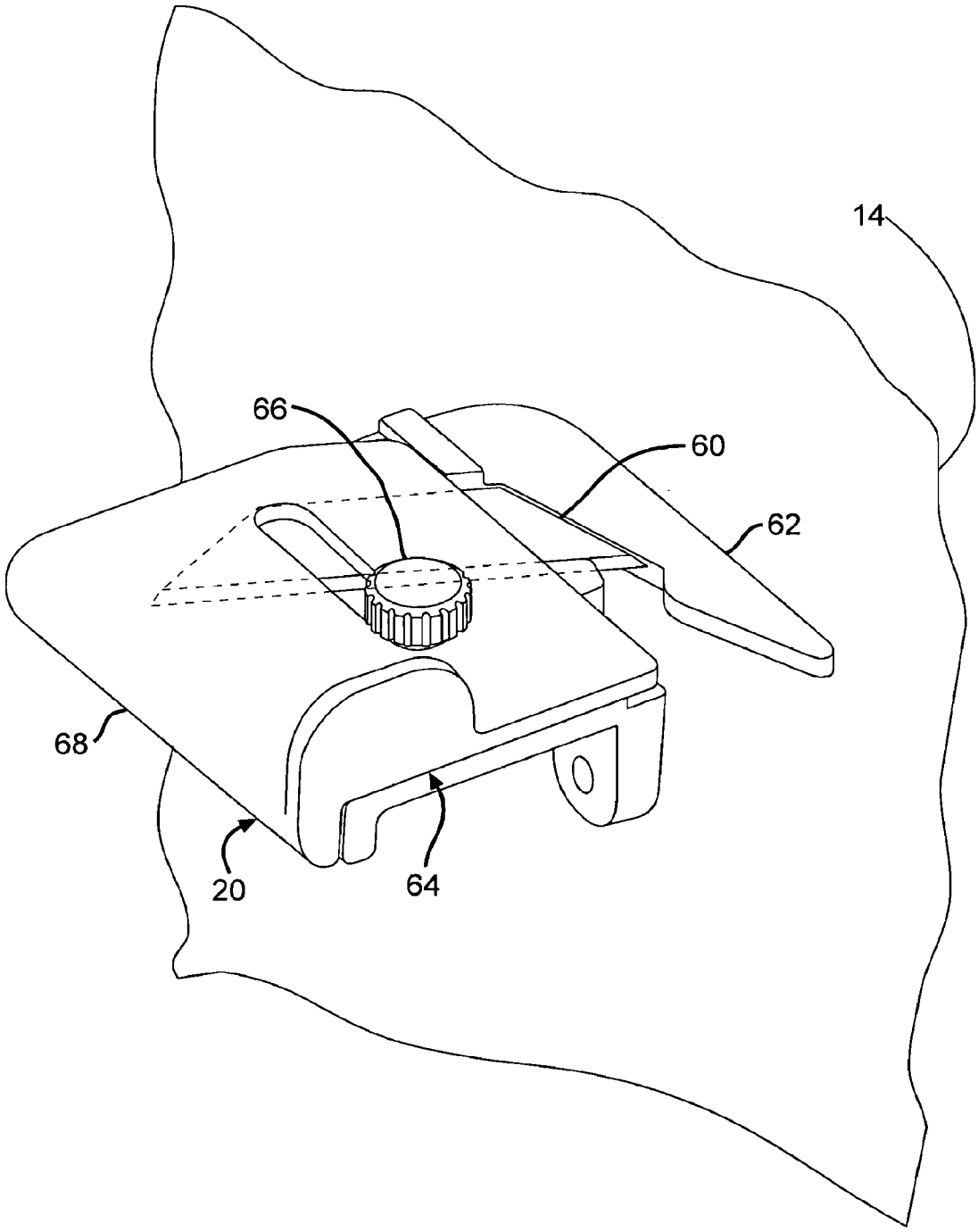
FIG. 10 is a perspective view of the cutting mechanism of the insulation blowing insulation machine of FIG. 1.

The knife edge 60 and protective cover 62 can be extended within the chute 14 by an adjustment slide assembly 64. The adjustment slide assembly 64 includes an adjustment knob 66 and an adjustment plate 68, as shown in FIG. 10. The adjustment knob 66 contacts the adjustment plate 68 and prevents the adjustment plate 68 from moving when the adjustment knob 66 is tightened. In operation, the machine operator loosens the adjustment knob 66 which allows the adjustment plate 68 to move. Movement of the adjustment plate 68 extends the knife edge 60 and the protective cover 62 into and out of the interior of the chute 14.

As shown in FIG. 10, the cutting mechanism 20 includes a knife edge 60 and a protective cover 62. The knife edge 60 can be made of metal, plastic or any other material sufficient to cut the bag 22 of blowing insulation. In another embodiment, the cutting mechanism 20 could include a hot wire configured to open the bag 22 by melting a tear seam in the bag 22, a laser, a saw toothed member, or any other mechanism suitable to open the bag 22 of compressed blowing insulation as the bag 22 moves relative to the chute 14.

As shown in FIG. 10, the protective cover 62 extends over the knife edge 60 to protect the machine user from accidental contact with the knife edge 60. The protective cover 62 can be made of reinforced plastic, metal, or any other sufficient to extend over the knife edge 62 and protect the machine user. In this embodiment, the protective cover 62 extends the length of the knife edge 60 for the safety of the machine user. Alternatively, the protective cover 62 can extend over only a portion of the knife edge 60 or the protective cover 62 can extend beyond the knife edge 60.

In another embodiment, the protective cover 62 could be spring loaded and close on the knife edge 60 when the blowing insulation machine is not in use. In this embodiment, the protective cover 62 would open allowing access to the knife edge 60 only when the blowing insulation machine 10 is in use. Alternatively, the protective cover 62 can be any mechanism, assembly, or structure that protects the machine user from accidental contact with the knife edge 60.

As shown in FIG. 3, the cutting mechanism 20 can be disposed on the side 16*a* of the chute 14. The cutting mechanism 20 can be disposed on the center of a side 16*a* or any of other position on a side 16*a* sufficient to cut the bag 22 of blowing insulation. Alternatively, the cutting mechanism 20 can be disposed on side 16*b* of the chute 14. In this embodiment, the cutting mechanism 20 can be disposed on the center of side 16*b* or any other position on side 16*b* sufficient to cut the bag 22 of blowing insulation.

The blowing insulation in the bag 22 of compressed blowing insulation can be any loose fill insulation, such as a multiplicity of discrete, individual tuffs, cubes, flakes, or nodules. The blowing insulation can be made of glass fibers or other mineral fibers, and can also be organic fibers or cellulose fibers. Typically, the loose fill insulation is made of glass fibers although other insulation materials such as rock wool, mineral fibers, organic fibers, polymer fibers, inorganic material, and cellulose fibers. Other particulate matter, such as particles of foam, may also be used. Combinations of any of the aforementioned materials are another alternative. The blowing insulation can have a binder material applied to it, or it can be binderless.

The blowing insulation in the bag 22 is typically compressed to a compression ratio of at least 10:1, which means that the unconstrained blowing insulation after the bag 22 is opened has a volume of 10 times that of the compressed blowing insulation in the bag 22. Other compression ratios higher or lower than 10:1 can be used. In one embodiment, the bag 22 has approximate dimensions of 9 inches high, 19 inches wide and 21 inches long, and weighs approximately 13 pounds. A typical chute 14 for such a bag 22 will have a cross-section of approximately 10 inches high by 20 inches wide. The bag itself is typically made of a polymeric material, such as polyethylene, although any type of material suitable for maintaining the blowing insulation in the desired compression can be used.

Preferably, the bag 22 will provide a waterproof barrier against water, dirt and other deleterious effects. By using a polymeric material for the bag 22, the compressed blowing insulation will be protected from the elements during transportation and storage of the bag 22. The preferred bag material is sufficiently robust to handle the physical abuse to which these bags are frequently subjected.

Alternatively, blowing insulation may be inserted into the machine manually, without the bag being inserted into the chute.

Figure 11:
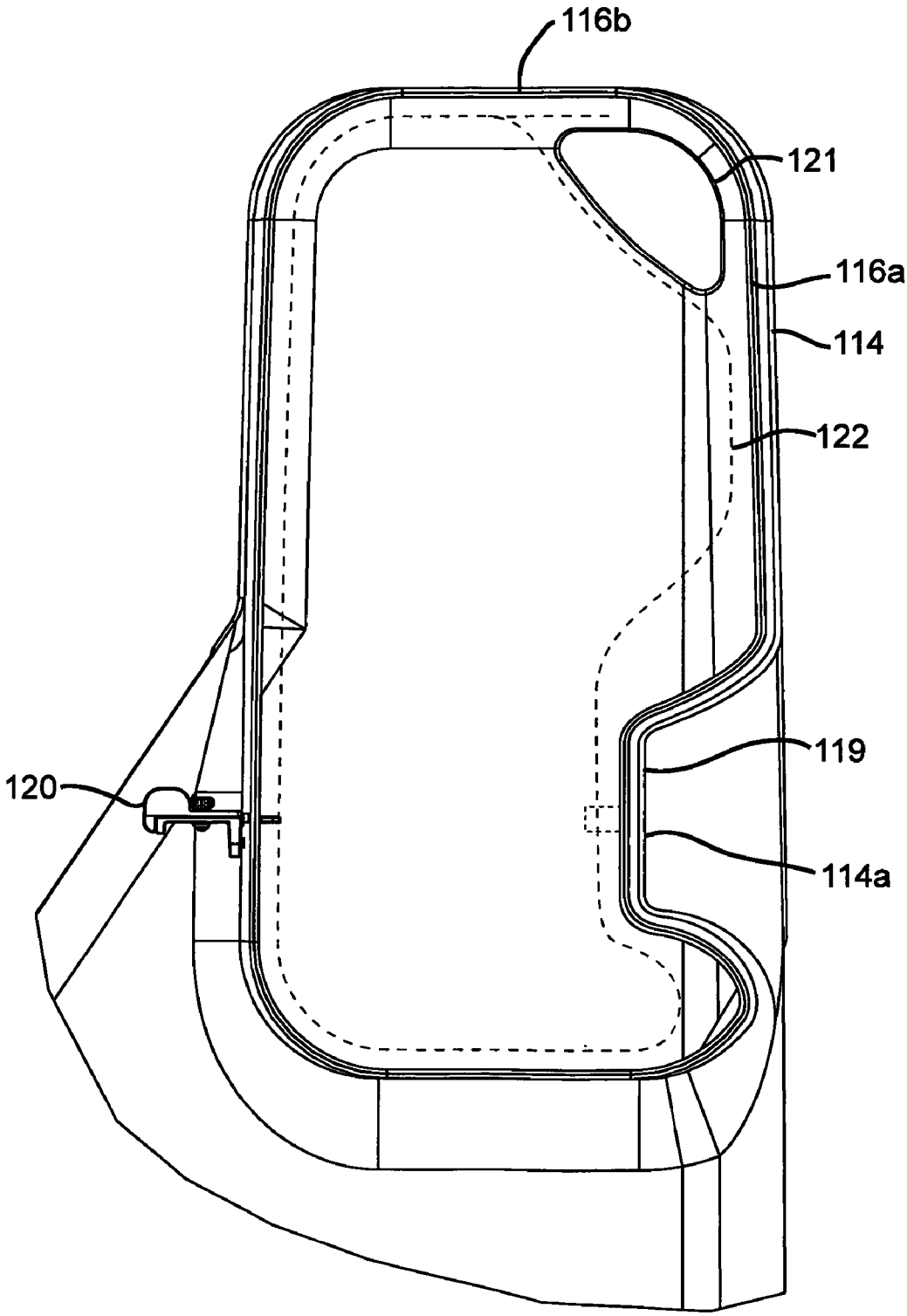
FIG. 11 is a side view of an alternate embodiment of the chute having an integral protrusion which forms the guide assembly.

As shown in FIG. 11 in another embodiment, the chute 114 can be formed to include a protrusion 114*a* extending toward the interior of the chute 114 from a side 116*a* of the chute 114. In this embodiment, the protrusion 114*a* forms the guide assembly 119 configured to urge the bag 122 toward the cutting mechanism 120. The protrusion 114*a* can be wedge-shaped or alternatively, the protrusion 114*a* can be any shape or configuration sufficient to urge the bag 122 toward the cutting mechanism 120. In this embodiment, the cutting mechanism 120 is disposed opposite the protrusion 114*a*. Alternatively, the cutting mechanism 120 can be disposed on the interior surface of the protrusion 114*a*. In this embodiment, the protrusion 114*a* urges the bag 122 of blowing insulation toward the opposite side 116*a* of the chute 114. The bag 122 of compressed blowing insulation resists the urging of the protrusion 114*a* resulting in constant contact of the bag 122 against the cutting mechanism 120 mounted on the protrusion 114*a*. The constant contact of the bag 122 against the cutting mechanism 120 allows the cutting mechanism 120 to cut the bag 122 as the bag 122 moves relative to the chute 114.

The principle and mode of operation of this blowing insulation machine have been described in its preferred embodiments. However, it should be noted that the blowing insulation machine may be practiced otherwise than as specifically illustrated and described without departing from its scope.

What is claimed is:

1. A machine for distributing insulation from a bag of insulation, the machine comprising:

a chute having an inlet end, an outlet end and opposing first and second longitudinal sides, the chute configured to receive the bag of insulation;

a cutting mechanism extending from the first longitudinal side toward the second longitudinal side of the chute and configured to open the bag of insulation, the cutting mechanism including a protective cover extending from the first longitudinal side toward the second longitudinal side and configured to substantially protect the machine operator from contact with the cutting mechanism, wherein the cutting mechanism and the protective cover are configured for movement within the chute relative to the first longitudinal side;

a plurality of shredders mounted at the outlet end of the chute and configured to shred and pick apart the insulation; and a discharge mechanism for distributing the insulation into an airstream.

2. The machine of claim 1 in which the protective cover extends the length of the cutting mechanism.

* * * * *